United States Patent [19]

Mahoney et al.

[11] 4,248,148

[45] Feb. 3, 1981

[54] TIME SHARED SHIFTING PRINT HAMMER ASSEMBLY

[75] Inventors: Frank A. Mahoney, Wyncote; Ronald W. F. Hutley, Lansdale, both of Pa.

[73] Assignee: Sperry Corporation, New York, N.Y.

[21] Appl. No.: 953,378

[22] Filed: Oct. 23, 1978

[51] Int. Cl.[3] ..... B41J 9/12

[52] U.S. Cl. ..... 101/93.09; 101/93.34; 101/93.48

[58] Field of Search ..... 101/93.04, 93.09, 93.15, 101/93.14, 93.16, 93.34, 93.29, 93.48

[56] References Cited

U.S. PATENT DOCUMENTS

| | | | |
|---|---|---|---|
| 3,606,834 | 9/1971 | Nyman et al. | 101/93.34 |
| 3,911,814 | 10/1975 | Helms et al. | 101/93.16 |
| 3,924,528 | 12/1975 | Ludin | 101/93.29 X |
| 3,971,311 | 7/1976 | Deproux | 101/93.04 |
| 3,983,806 | 10/1976 | Ishi | 101/93.34 X |
| 4,014,258 | 3/1977 | Wassermann | 101/93.34 X |

OTHER PUBLICATIONS

Wieselman, "Printer Technology and its Future," Data Products Corporation Publication, before May 1975.

*Primary Examiner*—Edward M. Coven
*Attorney, Agent, or Firm*—J. B. Sowell; W. E. Cleaver; M. M. Truex

[57] ABSTRACT

A plurality of print hammers are mounted on a horizontally movable carriage and adapted to scan a plurality of column positions of an impact printer. Each print hammer is provided with an energizible electrical coil which moves horizontally with the print hammers in the scan direction. The energizible electric coils on the print hammers cooperate with a fixed magnetic field provided by a pair of fixed bar magnets which extend beyond the distance scanned by the energizible coils on the print hammers.

7 Claims, 2 Drawing Figures

TIME SHARED SHIFTING PRINT HAMMER ASSEMBLY

BACKGROUND OF THE INVENTION

1. Field of the Invention

This invention relates to a print hammer assembly and the actuating mechanism for the print hammer assembly of a line impact printer. More particularly, this inventions relates to a novel movable carriage having a plurality of print hammers mounted thereon. Each movable print hammer is adapted to scan a plurality of column positions.

2. Description of the Prior Art

Prior art single element typewriters and single element printers have been provided with spherical balls, cylindrical drums, cylindrical wheels and annular daisy wheel shaped hammers having a plurality of characters thereon. Such typewriters and printers are capable of typing or printing long lines of characters one column at a time. The desired character of the character carrying element is designed to strike a paper medium so as to leave a character impression thereon.

Impact printers may also employ moving character bearing elements, however, the moving character or font is placed in a position of the backing roll of a typewriter behind the paper to be imprinted with the character. A plane face printing hammer is positioned on the opposite side of the paper and is adapated to strike the paper and press it against the character or font.

Single element typewriters and printers have a relatively heavy amount of moving parts and are limited to around 300 words per minute. Impact line printers having moving characters or font in the form of drums, bands, chains or bars may employ print hammers at every column position, thus substantially increasing the speed of printing a line of characters. High speed impact printers having a print hammer at each column position are capable of printing up to 4,000 lines per minute.

Heretofore, impact printers have employed print hammers which print more than one column position. Also, impact printers have employed print hammers which were mobilized to scan a complete line of column positions. Impact printers have employed a plurality of fixed print hammers which are arranged to print more than a single column of characters in a line printer. In this latter type of printer, the head of the print hammer is designed to span more than one column position and is then selectively actuated to print one of the desired column positions.

High speed impact printers gain most of their speed advantage by reducing the mass of the print hammers to a minimum and by employing high speed fixedly mounted actuating mechanisms as separate elements. If the parts or elements of the actuating mechanism are physically connected to or made part of the print hammers, the effective mass of the print hammers is increased which ordinarily results in a decrease in printing speed. To overcome the increase in effective mass of parts connected to the actuating mechanisms, the return springs and size of the actuators must ordinarily be increased which further increases the mass of the moving system.

Heretofore, single element typewriters and printers as well as single element moving impact printing actuators have been employed in low speed printing mechanisms.

Single element typewriters and printers are relatively inexpensive when compared to high speed printers.

It would be desirable to provide a medium or high speed impact printer at a cost comparable to single element typewriters, single element printers and single element moving impact printers.

SUMMARY OF THE INVENTION

It is the primary object of the present invention to provide a low-cost medium or high speed impact printing hammer assembly for a moving font impact printer.

It is another object of the present invention to provide a novel low mass, fast actuating print hammer.

It is another object of the present invention to provide a movable print hammer assembly having a plurality of print hammers, each adapted to scan and to print a plurality of column positions.

It is yet another object of the present invention to provide a novel permanent magnet field assembly adapted to cooperate with a plurality of horizontally movable print hammers.

According to these and other objects of the present invention to be explained in detail hereinafter, there is provided a print hammer assembly comprising a plurality of print hammers mounted on a carriage for reciprocal movement in a horizontal direction. Each of the print hammers is provided with a flat energizible coil which is disposed in the air gap between two fixedly mounted permanent bar magnets. Each print hammer is adapted to be actuated at a plurality of column positions when disposed opposite a desired character on a moving font medium.

DESCRIPTION OF THE PREFERRED EMBODIMENT

Figure 1:
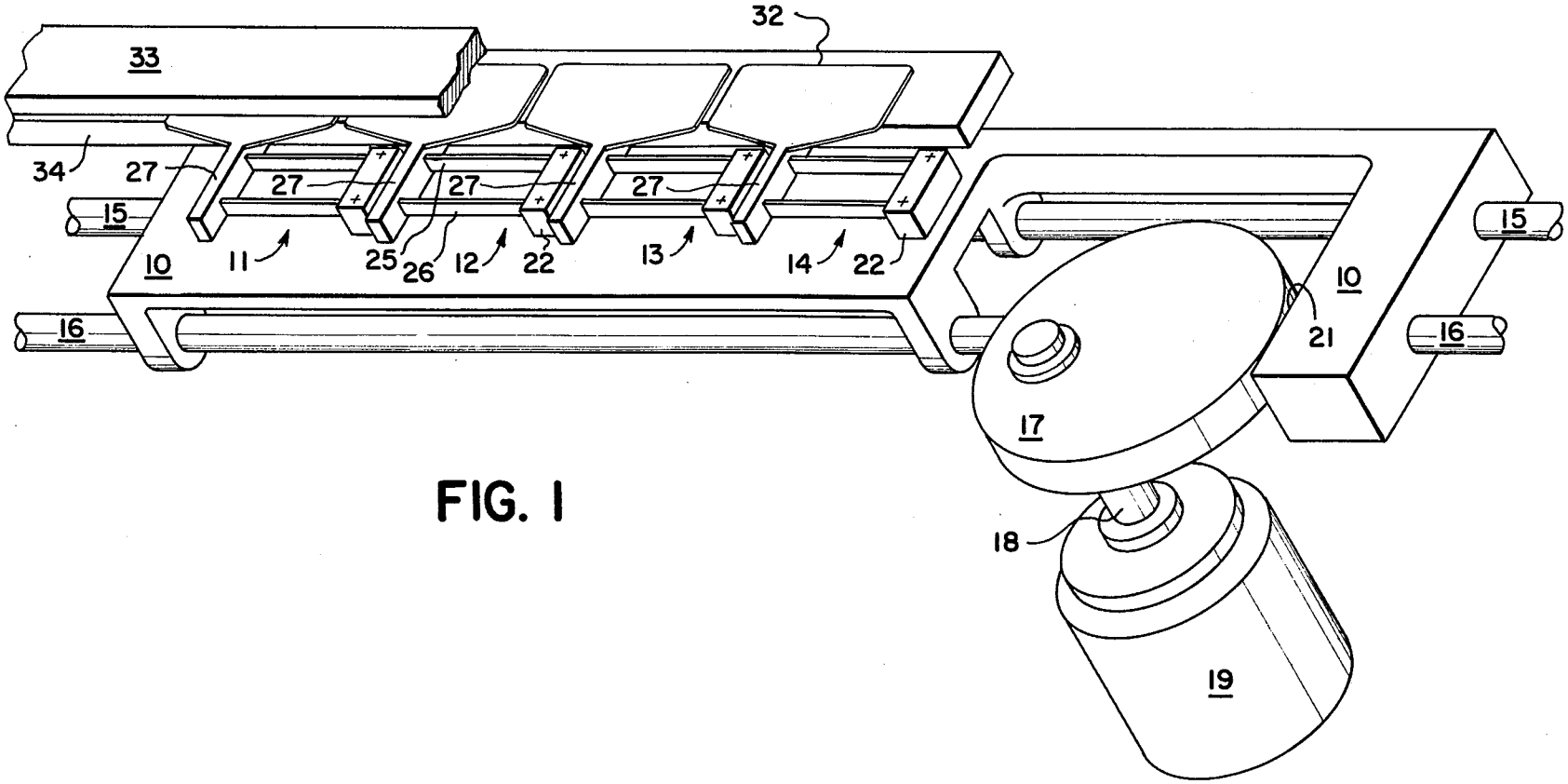
FIG. 1 is an isometric view of a plurality of print hammers mounted on a horizontally movable carriage.
Figure 2:
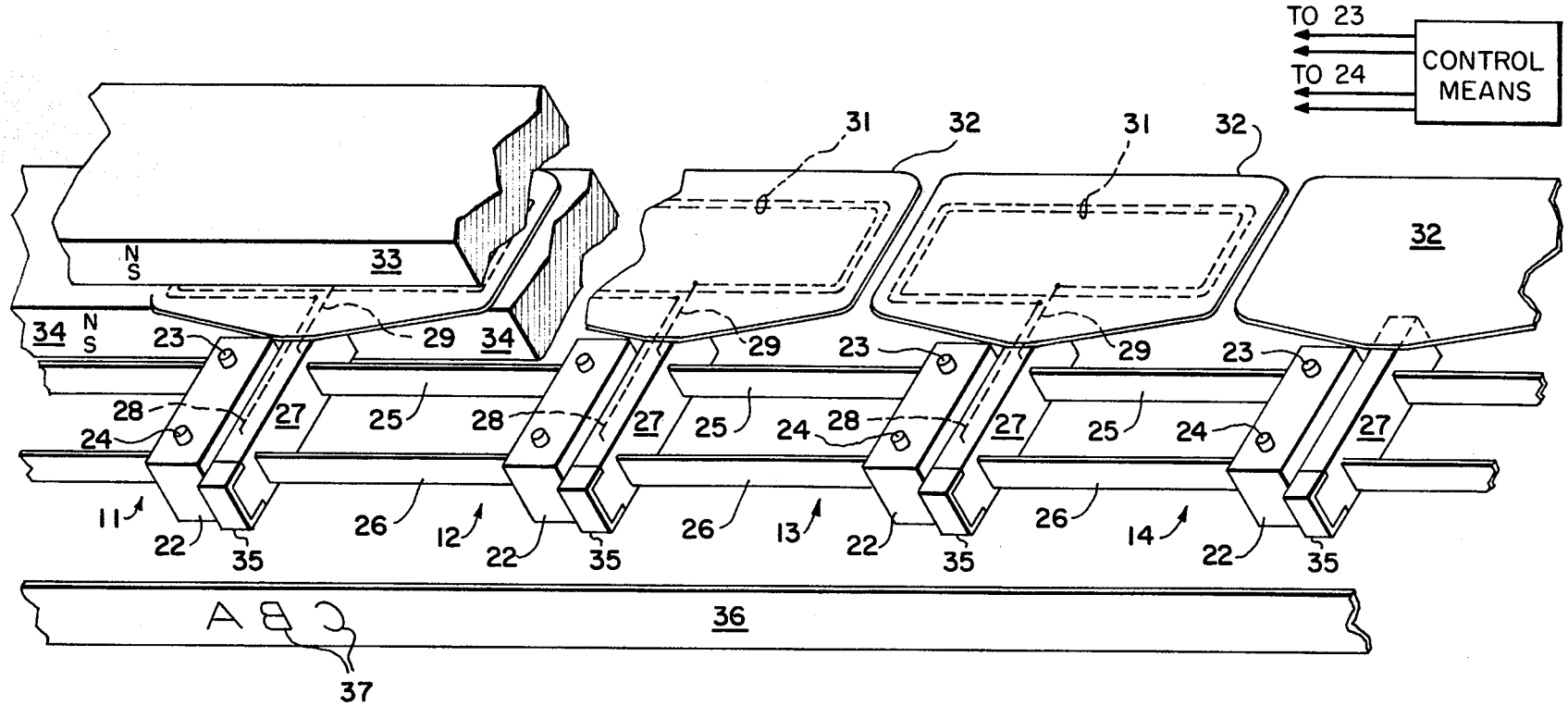
FIG. 2 is an enlarged isometric view of the print hammers mounted on a horizontally movable carriage showing the flat energizible coils and the cooperating permanent bar magnets.

Refer now to both FIGS. 1 and 2 which show a preferred embodiment horizontally movable carriage 10 having a plurality of print hammers 11, 12, 13, and 14 mounted thereon. Carriage 10 is slidably mounted on support rods 15 and 16 which are provided with frictionless bearings. The support rods 15 and 16 are connected to the fixed base or frame of the printing mechanism (not shown). Cam 17 is eccentrically mounted on shaft 18 of a drive motor 19. The drive motor may be a printed circuit motor, a stepping motor or a continuously rotating motor of the most simple type. The cam 17 is adapted to engage a cam follower 21 on carriage 10. Carriage 10 and cam follower 21 are biased into engagement with the eccentric cam 17 to maintain continuous engagement therewith.

While only four print hammers 11–14 are shown in order to illustrate details of the present invention in enlarged views, a preferred embodiment commercial high speed printer may employ 16 actuating hammer assemblies. Each of the hammer assemblies may be adapted to scan eight column positions to provide 128 columns of characters on a single line. Additional actuating hammer assemblies 11–14 may be added on the carrier 10 or each hammer assembly 11–14 may be adapted to scan more or less than eight columns to achieve wide flexibility in the selection of the number of characters to be printed per line.

Mounting blocks or anchors 22 are made of an insulating plastic. Each print hammer assembly 11–14 is preferably attached to the movable carriage 10 by means of removable screws (not shown) which attach the mounting blocks 22 to the carriage 10. Electrical terminals 23, 24 extend into the mounting blocks 22 and connect to the flexible springs 25, 26 which are potted or encapsulated into the mounting blocks 22 at their fixed ends. Preferably, flexible springs 25, 26 are electrically conductive, however, flexible electrical leads or conductors may be mounted on the flexible spring 25, 26. Springs 25, 26 extend into the plastic hammer body 27 of the print hammers 11–14 and are connected to electrical leads 28, 29 shown by dotted lines. Preferably the leads 28, 29 are potted inside the print hammer body 27 to avoid the possibility of their being rubbed or abraided. However, recessed protective areas may be provided in the upper portion of the hammer body 27 and ordinary conductive wires mounted in the recesses or trenches (not shown). Lead 28 is shown connected to one end of coil 31 and lead 29 is shown connected to the other end of the coil 31. It will be understood that electrical current applied to terminals 23, 24 will be conducted through the flexible support springs 25, 26, leads 28, 29 and to coil 31. Coils 31 are preferably made by etched foil techniques on a thin insulating circuit board 32 and then covered over with a laminate which forms an insulting and protecting layer. This layer may be an epoxy film or a cloth adhesive layer. Electrical connections between leads 28, 29 and the ends of coil 31 may be made by conventional soldering, conductive pins or by face to face pressure contact during assembly of the fan shaped circuit board 32 onto the hammer body 27.

Coil 31 extends into the air gap formed by the juxtaposed permanent bar magnets 33, 34 which are fixed to and supported by the fixed base of the printer (not shown).

Bar magnets 33, 34 have their magnetic poles oriented normal to the horizontal plane of the bar magnets. The polarities of the bar magnets are arranged so that the opposite polarities are juxtaposed opposite sides of the coil 31 and circuit board 32 creating a stationary magnetic field whose lines of flux or force extend across the air gap formed by the juxtaposed bar magnetics 33, 34. The permanent magnetic field is opposed by the electrical field generated in coils 31 when current flows therein to cause the print hammers 11–14 to be forced away from the bar magnets 33, 34 when the proper current flows in the coils 31.

The front edge of plastic hammer body 27 is provided with a hard metalic hammer face 35 preferably made of light metal. The hammer face 35 of the print hammers 11–14 is adapted to engage a multi-layer paper and carbon medium (not shown) which is pressed into engagement with the movable print band 36 having alpha numeric characters 37 thereon. Flexible bands like band 36 are well known in the impact printing art and maybe made in the form of an endless metallic belt driven by and supported on two pulleys (not shown).

The manner in which the current is applied to coils 31 to cause the moving print hammers 11–14 to engage the moving flexible band 36 at the correct column position is well known in the impact printer art and need not be explained in detail herein. Control means 38 of a known type are capable of actuating the energizible coils 31 to achieve impact printing.

It has been found that the carriage 10 and print hammers 11–14 may be made substantially of durable light weight plastic so that the movable carriage 10 and actuated print hammer assemblies thereon will weigh less than three quarters of a pound and that individual print hammer bodies with coils mounted on the printed circuit boards thereon weigh less than one ounce. This very small amount of mass assures rapid acceleration of the print hammers 11–14 with a small amount of energizing current. The low mass print hammers also are capable of engaging the paper material (not shown) against the characters 37 at high accelerations to prevent smear and also to insure that the print hammers bounce or return without the requirement of dampers and auxiliary retraction springs. The rear end of the plastic hammer bodies 27 is adapted to engage the lower bar magnet 34, thus, limiting the return stroke of the print hammer and forming a natural damper.

Having explained the preferred embodiment light weight carriage which supports and moves a plurality of time shared moving print hammers 11–14 in a horizontal plane, it will be understood that the heavy bar magnets 33, 34 are stationary and that the light weight fan-shaped circuit boards 32 having coils 31 thereon are continuously moving to and fro in a reciprocating motion in the air gap of the stationary bar magnets 33, 34.

Time sharing not only reduces the number of print hammers required for printing a long line of type having a plurality of columns, but also permits a simplified and non-congested arrangement of the printer hammers on the moving carriage. Each of the print hammers are interchangable without the requirement of precision tuning and adjustments which would ordinarily be required for very high speed impact printers.

We claim:

1. A movable print hammer assembly for a line impact printing mechanism in which each print hammer prints a plurality of columns of a line, said printing mechanism having a fixed base and horizontally moving type characters, the combination comprising:

a print hammer carriage slidably mounted on said fixed base to provide horizontal movement parallel to said type characters, a plurality of print hammers mounted on said print hammer carriage for movement therewith, said print hammers being mounted in a horizontal plane and provided with independent movement transverse to said type characters, each said print hammer comprising:

a print hammer body, a print hammer face at one end of said print hammer body, and a flat energizible coil mounted on a fan-shaped circuit board at the other end of said print hammer body, flexible support means having movable ends attached to said print hammer body and fixed ends attached to said print hammer carriage, said flexible support means being arranged in the same horizontal plane as said print hammer bodies and spaced between adjacent print hammer bodies, said print hammer faces being spaced in said horizontal plane a plurality of columns apart and being adapted to print characters in a plurality of columns, a pair of bar magnets one on each side of said flat energizible coils, said magnets being fixed to said base and arranged parallel to each other and to said type characters to provide a continuous uniform air gap therebetween for receiving said energizible coils on said print hammer bodies, drive means for imparting reciprocal movement to said print hammer carriage, and means for energizing said flat energizible coils in timed relationship to the movement of said type characters, whereby said print hammers are moved to engage a plurality of said moving type charactes in different column positions along each line to be printed.

2. A print hammer assembly as set forth in claim 1 wherein said pair of bar magnets are mounted on said fixed base with the opposite polarities facing said energizible coils.

3. A print hammer assembly as set forth in claim 1 wherein said pair of bar magnets comprise permanent magnets having flux lines oriented normal to and passing through said flat energizible coils.

4. A print hammer assembly as set forth in claim 1 which further includes insulating anchor means for receiving said ends of said flexible support means.

5. A print hammer assembly as set forth in claim 4 which further includes terminal posts connected to said flexible support means extending from said insulating anchor means, and wherein said flexible support means comprises flexible conductors having leads connected to said terminal posts on said anchor means.

6. A print hammer assembly as set forth in claim 5 wherein said flat energizible coil comprises a printed circuit etched foil coil electrically connected to said terminal post on said anchor means.

7. A print hammer assembly as set forth in claim 1 wherein said flexible support means and said print hammer body are movable in a horizontal plane and said flat energizible coil moves in said horizontal plane between said pair of bar magnets.

* * * * *